United States Patent [19]

Pezzoli

[11] Patent Number: 4,977,932

[45] Date of Patent: Dec. 18, 1990

[54] EDGE GUIDE FOR WEFT GRIPPER BELT

[75] Inventor: Luigi Pezzoli, Leffe, Italy

[73] Assignee: Vamatex S.p.A., Villa Di Serio, Italy

[21] Appl. No.: 389,973

[22] Filed: Aug. 7, 1989

[30] Foreign Application Priority Data

Sep. 8, 1988 [IT] Italy ..... 21865A/88

[51] Int. Cl.[5] ..... D03D 47/14

[52] U.S. Cl. ..... 139/449; 474/140

[58] Field of Search ..... 139/449, 443, 444, 446; 198/840; 226/173, 52; 74/89.2; 474/140, 167

[56] References Cited

U.S. PATENT DOCUMENTS 3,682,204 8/1972 Dewas ..... 139/449
3,916,957 11/1975 Dewas ..... 139/449 X
4,010,776 3/1977 Flamand ..... 139/449

*Primary Examiner*—Andrew M. Falik

*Attorney, Agent, or Firm*—Young & Thompson

[57] ABSTRACT

A guide for the motion of a pair of weft grippers inside the shed of a shuttleless loom, in which two control straps each carrying one of the grippers move on a substantially horizontal plane under the action of two gearwheels with reciprocating motion. A plurality of elements guide the straps in this motion, these guide elements being aligned on a sley facing a reed of the loom and positioned perpendicularly thereto, the straps having a substantially rectangular section of greater width than thickness and a shaped recess extending along each longitudinal side edge. The guide elements are substantially horizontal tooth projection, shaped like and engaged in those recesses. The projections are wedge-shaped, the apices of the wedges being substantially half way along the thickness of the straps. The straps are wider and thicker adjacent the grippers than remote from the grippers.

6 Claims, 2 Drawing Sheets

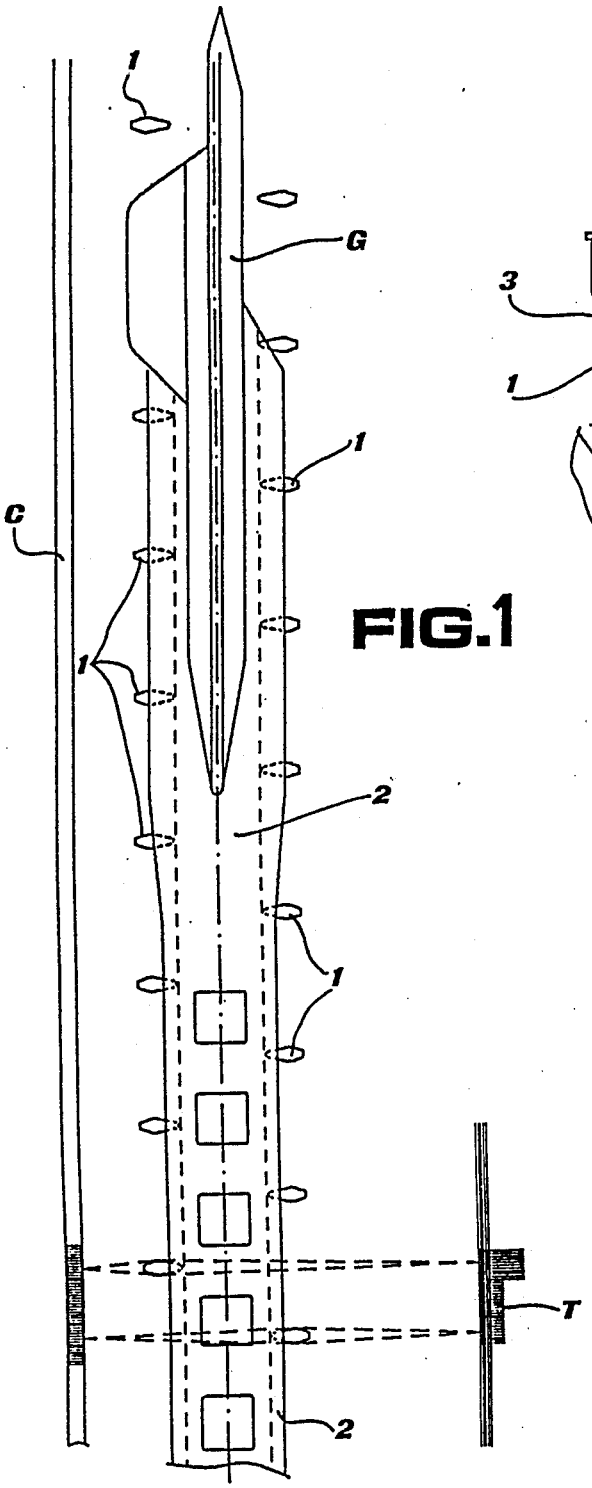
FIG.1
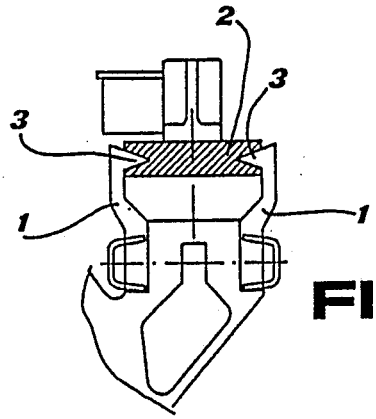
FIG.2
FIG.3
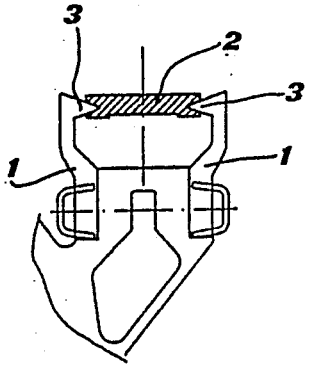

EDGE GUIDE FOR WEFT GRIPPER BELT

BACKGROUND OF THE INVENTON

The present invention concerns means to guide the to-and-fro motion of a pair of weft grippers inside the shed of looms with continuous weft feed, of the type comprising two control straps movable on a substantially horizontal plane under to the action of two gearwheels with reciprocating motion, and a plurality of elements to guide the straps, aligned on the sley facing the reed and positioned perpendicularly thereto.

It is known that modern shuttleless looms, of the type specified heretofore, still have to solve the problem of efficiently guiding the weft grippers—so as to guarantee that the reciprocal movements of said grippers, as well as their motion in respect of the sley and of the reed, are correct—and, at the same time, of limiting as far as possible the wear on the grippers, the straps and the other members involved in their motion, and the stresses on the warp yarns through which weft picking is carried out.

This problem has also been faced by the Applicant who has supplied, at successive intervals, some solutions thereof, among which the solution of the two European Pat. Nos. 131376 and 20427 and European application No. 87118502, can be mentioned.

SUMMARY OF THE INVENTION

The present invention intends to overcome the remaining drawbacks of these solutions and to supply an improved and more satisfactory solution for the problems concerning the stresses on the warp yarns, the space inside the shed, and the efficient and reliable guiding of the grippers, without acting negatively on the other parameters involved in the essential function of weft picking inside the shed of gripper looms.

For this purpose, the present invention supplies means to guide the motion of a pair of weft grippers inside the shed of shuttleless looms—of type comprising two control straps movable on a substantially horizontal plane under to the action of two gearwheels with reciprocating motion, and a plurality of guide elements for the straps, aligned on the sley facing the reed and positioned perpendicularly thereto—characterized in that the straps have a substantially rectangular section and are provided with a shaped recess on each side edge and in that the guide elements comprise tooth projections, shaped like said recesses so as to engage the same.

Said recesses and said projections are preferably wedge-shaped, the apices of the wedges being more or less on the centre of the straps.

Said straps are also preferably wider and thicker in the area and close to the area where the gippers are fixed thereto, whereby the recesses are made deeper in said areas so as to allow a more reliable and efficient engagement of the tooth projection of the the guide elements into said recesses.

BRIEF DESCRIPTION OF THE DRAWINGS

The invention is now described in further detail, with reference to a preferred embodiment thereof, illustrated on the accompanying drawings, in which:

FIG. 1 is a plan view of the system to guide the motion of weft grippers according to the invention; FIGS. 2 and 3 are two side elevations showing two pairs of guide elements for a gripper strap (shown in section) according to the invention, the strap being engaged by said elements in correspondence of its area carrying the gripper (FIG. 2) and, respectively, in correspondence of its area far from the gripper (FIG. 3)

DESCRIPTION OF THE PREFERRED EMBODIMENT

With reference to the drawings, it can be seen in FIG. 1 how the motion of the grippers G inside the warp shed of a loom—of which the reed C and the fabric T being formed are shown—is guided by a plurality of opposed and offset guide elements 1 engaging the gripper strap 2 on the side edges.

As shown in FIGS. 2 and 3, the guide elements 1 area characterized—according to the invention—by tooth projections 3, which engage the strap 2 in recesses of complementary shape, formed on the sides thereof, the strap being made of suitable thickness. The shape of the tooth projections 3 and of the corresponding recesses in the strap sides will preferably be a wedge shape, with triangular section, as clearly illustrated.

As can be seen at once from FIGS. 1 to 3, the strap 2 is preferably thicker and wider in its end area where the gripper P is fixed thereto, and close to said area (FIGS. 1 and 2), which is smoothly radiused to all the remaining part of the strap having a constant section and being thinner and narrower (FIGS. 1 and 3). Of course, in order to be able to guide such a strap 2 with said guide elements, the recesses formed in the strap sides in correspondence of its thicker and wider area should be far larger and deeper than in the remaining major part of the strap, so as to be able to properly house a far larger portion of the wedge-shaped tooth projections 3 of the elements 1 than that housed by the narrower and thinner area of the strap.

In use, the strap 2 is very well guided by the guide elements 1, due to the precise and efficient engagement of the wedge-shaped tooth projections 3 of said elements in the corresponding recesses of the strap sides, throughout the length of the strap. In particular, said engagement is increased and improved in correspondence of the strap areas where the weft gripper is fixed, and in the area just adjacent thereto, because of the increased width and thickness of the strap, and the consequent greater extension of the cooperating and guiding surfaces between the teeth 3 of the elements 1 and the widened side recesses of the strap 2.

This improved guiding action is accompanied by a marked decrease of the stresses on the warp yarns.

Figure 4:
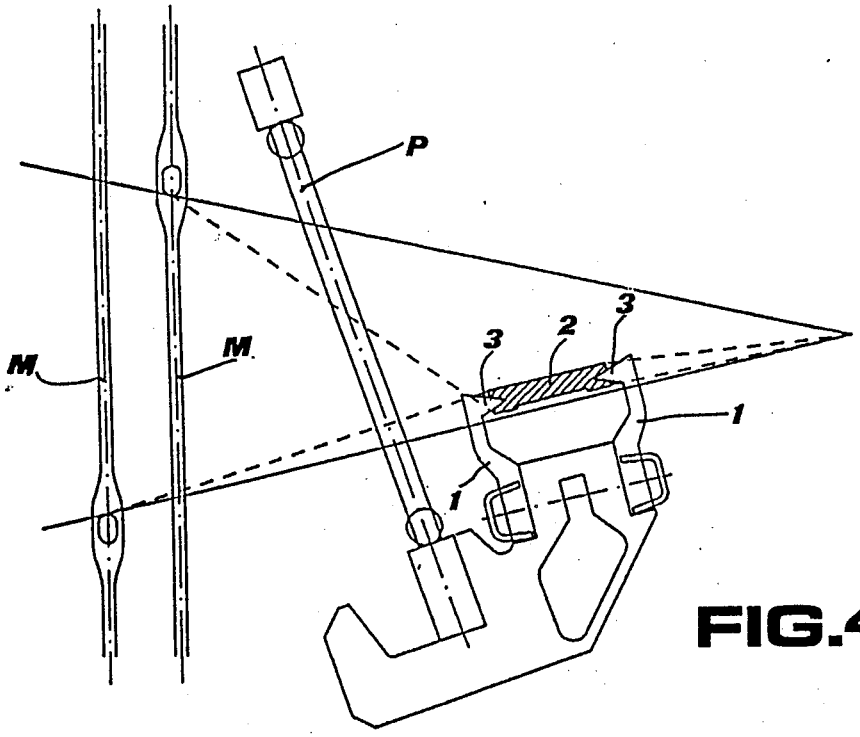
FIGS. 4 and 5 show how the strap and its guide elements behave in respect of the warp yarns of the loom, and show the wide space available for the motion of the grippers inside the warp shed.

In fact, as can well be seen from FIG. 4, when a warp yarn, lifted or lowered by a link M of the healds, engages the strap 2 slidable on the guide elements 1—due to the substantially rectangular section of the strap 2 and to the particular cooperation between the guide elements 1 and the strap 2, obtained by engagement of the tooth projections 3 of said elements in the side recesses of the strap—the yarn can by no means insert itself between the strap and the wedgeshaped teeth, since in both cases the edge of the strap keeps the yarn well apart from the end contact areas of the two mutually slinding parts, in which it could get caught (it in fact often gets caught and torn or damaged in the conventional solutions).

Figure 5:
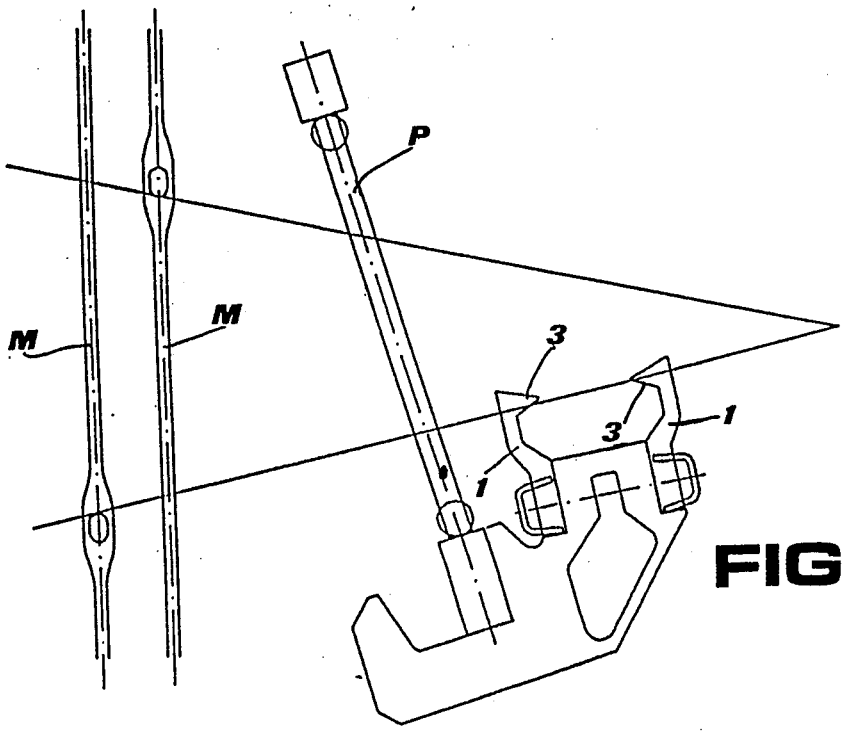

On the other hand, as can be seen equally well from FIG. 5, when the guide elements 1 move down towards the lower warp web, due to the motion of the loom sley to which they are fixed, the typical phenomenon of the warp yarns getting caugth in the guide teeth—which frequently leads to the breakage and still more frequently to the damage of said yarns in conventional looms—does not take place. In fact, the yarn, engaged by the strongly inclined lower portion of the wedge-shaped tooth 3 of the guide elements 1 according to the invention, easily and harmlessly slips upward to the side of said tooth, instead of remaining caught and violently stressed downward, as happens with the conventional guide members, which are made—as known—in the form of hook projections, the lower side of which is not inclined but substantially horizontal.

The means to guide the motion of weft grippers in looms, according to the invention, thus obtain a reliable and precise guiding action and prevent any troublesome stresses on the yarns of the two warp webs.

I claim:

1. Means to guide the motion of a pair of weft grippers inside the shed of a shuttleless loom, in which two control straps each carrying one of the grippers move on a substantially horizontal plane under the action of two gearwheels with reciprocating motion, and a plurality of elements guide the straps in this motion, said guide elements being aligned on a sley facing a reed of the loom and positioned perpendicularly thereto, the straps having a substantially rectangular section of greater width than thickness and a shaped recess extending along each longitudinal side edge, the guide elements comprising substantially horizontal tooth projections, shaped like and engaged in said recesses.

2. Means to guide the motion of weft grippers, as in claim 1, wherein said recesses and said projections are wedge-shaped, the apices of the wedges being substantially half way along the thickness of the straps.

3. Means to guide the motion of weft grippers, as in claim 1, wherein the straps are wider and thicker adjacent the grippers than remote from the grippers.

4. A strap for carrying a weft gripper inside the shed of a shuttleless loom, the strap being elongated and rectangular in cross section and having a width substantially greater than its thickness, the strap having a recess extending along each longitudinal side edge thereof for the reception of stationary guide elements thereby to guide longitudinal reciprocatory movement of the strap.

5. A strap as claimed in claim 4, said recesses being wedge-shaped and having apices disposed substantially half way along the thickness of the strap.

6. A strap as claimed in claim 4, in combination with a weft gripper carried thereby, said strap being wider and thicker adjacent the gripper than remote from the gripper.

* * * * *

UNITED STATES PATENT AND TRADEMARK OFFICE

CERTIFICATE OF CORRECTION

PATENT NO. : 4,977,932

DATED : December 18, 1990

INVENTOR(S) : Luigi PEZZOLI

It is certified that error appears in the above—identified patent and that said Letters Patent is hereby corrected as shown below:

Column 2, line 55, after "a" insert --lower--;
line 62, change "the yarn can" to --the lower warp yarn, which is disposed between the teeth 3, can--.

Column 3, line 23, (claim 1), after "loom," insert --said shed being comprised by upper and lower warp yarns,--.

Column 4, line 4, (claim 1), after "comprising" insert --a series of discontinuous--;
line 5, (claim 1), after "jections," insert --spaced apart from each other in a direction parallel to the straps and--;
line 5, (claim 1), change "recesses." to --recesses, said lower warp yarns being disposed between said tooth projections.--;
line 20, (claim 4), change "strap." to --strap, in combination with a weft gripper carried thereby, said strap being wider and thicker adjacent the gripper than remote from the gripper.--;
cancel lines 25-29 (claim 6).

Signed and Sealed this

Twenty-third Day of June, 1992

*Attest:*

DOUGLAS B. COMER

*Attesting Officer*

*Acting Commissioner of Patents and Trademarks*